US006811839B2

(12) United States Patent
Hiro et al.

(10) Patent No.: US 6,811,839 B2
(45) Date of Patent: Nov. 2, 2004

(54) RECORDING MEDIUM AND IMAGE FORMING PROCESS USING THE SAME

(75) Inventors: Masaaki Hiro, Kanagawa (JP); Kenji Shinjo, Kanagawa (JP); Katsutoshi Misuda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/985,542

(22) Filed: Nov. 5, 2001

(65) Prior Publication Data

US 2002/0097309 A1 Jul. 25, 2002

(30) Foreign Application Priority Data

| | | |
|---|---|---|
| Nov. 9, 2000 | (JP) | 2000-342064 |
| Feb. 28, 2001 | (JP) | 2001-055973 |
| Oct. 12, 2001 | (JP) | 2001-315120 |
| Oct. 12, 2001 | (JP) | 2001-315121 |

(51) Int. Cl.[7] ..... B41M 5/40
(52) U.S. Cl. ..... 428/32.3; 428/32.33; 428/32.34
(58) Field of Search ..... 428/32.3, 32.33, 428/32.34, 195, 206, 328, 331

(56) References Cited

U.S. PATENT DOCUMENTS

| | | | | |
|---|---|---|---|---|
| 4,202,870 A | | 5/1980 | Weber et al. | 423/630 |
| 4,242,271 A | | 12/1980 | Weber et al. | 260/448 |
| 4,248,852 A | | 2/1981 | Wakabayashi et al. | 423/626 |
| 4,504,640 A | | 3/1985 | Harada et al. | 526/193 |
| 4,528,347 A | | 7/1985 | Harada et al. | 526/219 |
| 4,540,760 A | | 9/1985 | Harada et al. | 526/211 |
| 4,723,129 A | | 2/1988 | Endo et al. | 346/1.1 |
| 4,812,540 A | | 3/1989 | Kageno et al. | 526/218.1 |
| 4,879,166 A | | 11/1989 | Misuda et al. | 428/212 |
| 5,041,328 A | | 8/1991 | Akiya et al. | 428/212 |
| 5,091,009 A | | 2/1992 | Nogami et al. | 106/287.1 |
| 5,104,730 A | | 4/1992 | Misuda et al. | 428/304.4 |
| 5,185,316 A | | 2/1993 | Egashira et al. | 503/227 |
| 5,221,497 A | | 6/1993 | Watanabe et al. | 252/313.2 |
| 5,264,275 A | | 11/1993 | Misuda et al. | 428/304.4 |
| 5,576,088 A | * | 11/1996 | Ogawa et al. | 428/327 |
| 5,798,147 A | * | 8/1998 | Beck et al. | 427/511 |
| 5,912,071 A | | 6/1999 | Takeshita et al. | 428/304.4 |
| 5,985,076 A | * | 11/1999 | Misuda et al. | 156/230 |
| 6,132,878 A | * | 10/2000 | Kojima et al. | 428/411.1 |
| 6,165,606 A | * | 12/2000 | Kasahara et al. | 428/323 |
| 6,183,851 B1 | * | 2/2001 | Mishima | 428/304.4 |
| 6,277,498 B1 | * | 8/2001 | Endo et al. | 428/500 |
| 6,391,428 B1 | * | 5/2002 | Ueno et al. | 428/195 |
| 6,391,440 B1 | * | 5/2002 | Yoshino et al. | 428/32.1 |
| 6,432,550 B1 | * | 8/2002 | Ohbayashi et al. | 428/511 |
| 6,517,929 B1 | * | 2/2003 | Shibatani et al. | 428/195 |

FOREIGN PATENT DOCUMENTS

| | | | | |
|---|---|---|---|---|
| EP | 0 869 010 A1 | | 10/1998 | |
| EP | 0 992 359 A2 | | 4/2000 | |
| EP | 1 031 431 A2 | | 8/2000 | |
| EP | 1 205 312 A1 | * | 5/2002 | B41M/5/00 |
| JP | 36-23231 | | 11/1961 | |
| JP | 52-9074 A | | 1/1977 | |
| JP | 54-59936 A | | 5/1979 | |
| JP | 55-51583 A | | 4/1980 | |
| JP | 56-157 A | | 1/1981 | |
| JP | 58-23809 A | | 2/1983 | |
| JP | 59-20696 A | | 2/1984 | |
| JP | 60-1071 B2 | | 1/1985 | |
| JP | 63-225608 A | | 9/1988 | |
| JP | 2-14364 A | | 4/1990 | |
| JP | 2-56361 B2 | | 11/1990 | |
| JP | 2-56362 B2 | | 11/1990 | |
| JP | 2-56365 B2 | | 11/1990 | |
| JP | 2-276670 A | | 11/1990 | |
| JP | 2-57082 B2 | | 12/1990 | |
| JP | 2-57083 B2 | | 12/1990 | |
| JP | 4-37576 A | | 2/1992 | |
| JP | 4-28232 B2 | | 5/1992 | |
| JP | 4-34512 B2 | | 6/1992 | |
| JP | 5-32037 A | | 2/1993 | |
| JP | 5-35163 B2 | | 5/1993 | |
| JP | 6-30951 B2 | | 4/1994 | |
| JP | 7-107228 B2 | | 11/1995 | |
| JP | 8-13569 B2 | | 2/1996 | |
| JP | 10-94754 A | | 4/1998 | |
| JP | 2803134 B2 | | 9/1998 | |
| JP | 2881847 B2 | | 2/1999 | |
| JP | 11-158271 A | | 6/1999 | |
| JP | 11-245504 A | | 9/1999 | |

OTHER PUBLICATIONS

Josef Rocek, et al., "Effect of Precipitation and Aging on Porous Structure of Aluminium Hydroxide. I. Statistical Treatment of Experimental Data", Collect. Czech. Chem. Commun., vol. 56, pp. 1253–1262, (Jun., 1991).

Josef Rocek, et al., "Porous Structure of Aluminium Hydroxide and Its Content of Pseudoboehmite", Applied Catalysis, vol. 74, pp. 29–36, (1991).

* cited by examiner

*Primary Examiner*—B. Shewareged
(74) *Attorney, Agent, or Firm*—Fitzpatrick, Cella, Harper & Scinto

(57) ABSTRACT

Disclosed herein is a recording medium comprising a base material, and at least one resin selected from a primary amine resin and a secondary amine resin and a hindered amine compound contained in the base material and/or on the surface of the base material.

13 Claims, 2 Drawing Sheets

RECORDING MEDIUM AND IMAGE FORMING PROCESS USING THE SAME

BACKGROUND OF THE INVENTION

1. Field of the Invention

The present invention relates to a recording medium suitable for use in recording using water-based inks and an image forming process using this recording medium. In particular, the present invention relates to a recording medium which permits forming images high in optical density, bright in color tone and high in resolution, and has excellent ink absorbency. The present invention also relates to an image forming process using such a recording medium. The images recorded on the recording medium of the present invention have excellent shelf stability.

2. Related Background Art

An ink-jet recording system is a system in which minute droplets of an ink (recording liquid) are ejected by any one of various working principles to be applied to a recording medium such as paper, thereby making a record of images, characters and/or the like. In an ink-let recording system, recording can be conducted at high speed and with a low noise, multi-color images can be formed with ease, recording patterns are very flexible, and development is unnecessary. The ink-jet recording system has been developed into information instruments led by printers and including copying machines, word processors, facsimiles and plotters. In recent years, high-performance digital cameras, digital video cameras and scanners have begun to be provided cheaply, and printers using an ink-jet recording system have been preferably used in output of image information obtained from these instruments together with the use of personal computers. As a result, there is a demand for simply and easily outputting by an ink-jet system images comparable in quality with silver salt photographs and multi-color prints by a plate making system.

Improvements in structures and recording systems of printers, such as speeding up and high definition of recording, and full-coloring of images, have been made in order to meet such demand. Improvements in structure and properties of recording media have also been investigated extensively.

With respect to recording media used in ink-jet recording and the like, a wide variety of recording media has heretofore been proposed. For example, Japanese Patent Application Laid-Open No. 52-9074 discloses recording media provided with, as an ink-receiving layer, a layer comprising a silica pigment having a great specific surface area as a main component for improving the ink-absorbing rate thereof and having voids, and Japanese Patent Application Laid-Open No. 63-22997 discloses recording media, in which voids in a pigment layer forming an ink-receiving layer are controlled. Japanese Patent Application Laid-Open Nos. 55-51583 and 56-157 describe the fact that non-crystalline silica is incorporated into an ink-receiving layer for the purpose of enhancing the ink absorbency of the ink-receiving layer to provide printed dots high in print density and free of feathering or bleeding.

On the other hand, recording media capable of forming images comparable with a silver salt photograph are required to permit forming images excellent in coloring ability of dyes and high in surface glossiness and resolution. Attention is being attracted to alumina hydrate as a component for an ink-receiving layer of recording media capable of providing images comparable with the silver salt photograph. For example, U.S. Pat. Nos. 4,879,166 and 5,104,730, and Japanese Patent Application Laid-Open Nos. 2-276670, 4-37576 and 5-32037 disclose recording media having a layer containing an alumina hydrate of a pseudo-boehmite structure as an ink-receiving layer. Japanese Patent Application Laid-Open No. 10-94754 discloses recording media in which alumina hydrate particles contained in an ink-receiving layer.

There has also been recently a demand for recorded images having good shelf stability. Methods for improving the shelf stability of recorded images have also been proposed. As methods for improving, for example, the shelf stability of images to light, Japanese Patent Publication No. 6-30951 discloses recording sheets containing a particular cationic compound, Japanese Patent Publication No. 4-28232 discloses recording sheets containing an aminoalcohol as a light fastness improver, and Japanese Patent Publication No. 4-34512 and Japanese Patent Application Laid-Open No. 11-245504 disclose recording sheets containing a hindered amine compound as a light fastness improver. Japanese Patent Publication No. 8-13569 also discloses the relationship between color change (mainly, a phenomenon that a black ink is changed into a brown color) when a recorded image is stored in a room and color change by ozone gas and that a silica pigment inhibited in surface activity is effective for preventing color change of an image in a room.

However, color fading phenomena, for example, occurring in the case where a recorded image is exhibited in a room, are so various that the whole image is tinged with red or tinted with green, or an imprinted area is yellowed. Causes for the color fading phenomena are not limited to light, and combined factors such as influences of various gases in the air, temperature and humidity are considered. However, there has not been yet known any method for solving fading phenomena of the image resulting from the influences of the combined factors.

The recording media (hereinafter referred to as "recording media for photograph") capable of forming images comparable with a silver salt photograph have a structure in which a transparent ink-receiving layer is provided in a thickness of at least several tens $\mu$m for the purpose of being adapted to photoprinters by which inks are applied at a high speed and in a great amount, and achieving excellent coloring ability of dyes and high surface glossiness. Such recording media have involved problems that the transparency of the ink-receiving layer is deteriorated to fail to form a bright or clear image, and the ink absorbency is lowered when an additive such as the above-described light fastness improver is contained in a great amount in the ink-receiving layer for the purpose of improving the shelf stability of an image to be formed. In addition, the method of modifying the pigment particles themselves for improving the color change in a room cannot be applied to such recording media. As described above, there is a further problem to be solved from the viewpoint of balance with recording properties in order to impart good fastness properties on images to the recording media for photograph.

SUMMARY OF THE INVENTION

It is an object of the present invention to provide a recording medium which can be suitably used in an image forming system using a recording system in which a recording liquid is applied to a recording medium to conduct recording, such as an ink-jet recording system. The recording medium of the present invention permits formation of images high in optical density, bright in color tone and high in resolution, and has excellent ink absorbency. The present invention also provides an image forming process using such a recording medium.

Another object of the present invention is to provide a recording medium which provides excellent shelf stability of an image recorded thereon, and an image forming process using such a recording medium.

A further object of the present invention is to provide a recording medium for photograph, which can provide a print having texture and image quality similar to a silver salt photograph, and an image forming process using such a recording medium.

The above objects can be achieved by the present invention described below.

According to the present invention, there is thus provided a recording medium comprising a base material, and at least one resin selected from a primary amine resin and a secondary amine resin and a hindered amine compound contained in the base material and/or on the surface of the base material.

These compounds may be present on the base material in direct contact with the base material or through another layer coming into contact with the base material.

According to the present invention, there is also provided a recording medium comprising a base material, an ink-receiving layer provided on the base material, and at least one resin selected from a primary amine resin and a secondary amine resin and a hindered amine compound contained in the interior and/or on the surface of the ink-receiving layer.

According to the present invention, there is further provided an image forming process, comprising the step of applying a recording liquid to the surface of the ink-receiving layer of the recording media described above according to recording information to form an image.

According to the present invention, the use of the recording media comprising the two compounds described above can prevent the occurrence of such various color fading phenomena of an image as described above even when images formed thereon by ink-jet recording are exhibited for a long period of time, for example, in a room. The images formed on such recording media thus have very high fastness properties. In particular, the present invention, which can be applied to recording media for photograph, permits formulation of images having texture and image quality comparable with a silver salt photograph without impairing the excellent recording properties thereof. Thus, images having very high fastness properties can be provided by an ink-jet recording system. In addition, an inputting system such as a digital camera is suitably selected, and the ink-jet recording system is used as an outputting system, whereby a print having an image which has texture comparable with that of a silver salt photograph, is superior to a silver salt photograph and also is excellent in fastness properties can be provided by a process more simply and at a higher speed than the silver salt photograph.

DETAILED DESCRIPTION OF THE INVENTION

Figure 1:
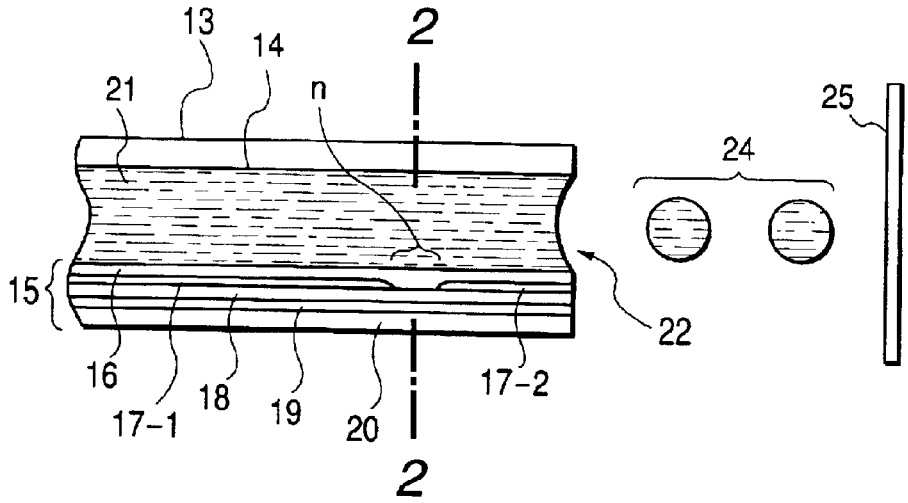
FIG. 1 is a longitudinal cross-sectional view of a head of an ink-jet recording apparatus.

The recording media according to the present invention have a structure at least having at least one resin selected from a primary amine resin and a secondary amine resin and a hindered amine compound in a base material or on the recording surface of the base material. Preferred is a structure having a base material, and an ink-receiving layer provided on the base material and at least containing at least one resin selected from a primary amine resin and a secondary amine resin and a hindered amine compound in the interior and/or on the surface of the ink-receiving layer. The present invention solves the above-described problems and achieves the objects of the present invention by containing these two compounds.

It has heretofore been known that a hindered amine compound functions as a radical scavenger and is effective in preventing deterioration of the various materials caused by light. However, in the case where the hindered amine compound is applied to recording media for ink-jet, for example, an ink-receiving layer of recording media provided with the ink-receiving layer having such an alumina hydrate as described in Related Background Art, it is necessary to use the hindered amine compound as an aqueous dispersion because the hindered amine compound is insoluble in water. When a recorded image is formed on a recording medium to which such a hindered amine compound has been applied, and the image is stuck on, for example, a disk or wall of an office and left to stand, a phenomenon in which the image is tinged with red, or an unprinted area is colored yellow occurs in several days to several weeks. This is considered to be attributable to the fact that factors other than light also affect the color fading of the image.

The present inventors have found that when at least one resin selected from a primary amine resin and a secondary amine resin among amine compounds, which have heretofore been considered to adversely affect the light fastness of an image, is caused to coexist with the hindered amine compound, the above-described color fading phenomenon is controlled. Compounds having a tertiary amine or quaternary ammonium group heretofore known as water fastness-imparting agents for ink-jet images tend to deteriorate color fading and often cause yellowing of an unprinted area even when they are used in combination with the hindered amine compound. On the other hand, when a recording medium contains only a primary amine resin, in particular, a magenta dye in an image formed thereon is markedly faded, and the image is tinted with green.

The present inventors have further found that even when at least one resin selected from a primary amine resin and a secondary amine resin and a hindered amine compound are caused to coexist with each other, the coloring ability and ink absorbency of the resulting recording medium for photograph are not adversely affected. The embodiments of the present invention will hereinafter be described in more detail.

<Hindered Amine Compound>

In the present invention, the hindered amine compound means a compound having, in its molecule, at least one hindered amine represented by the formula (1)

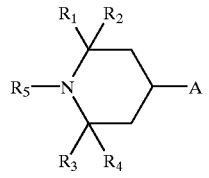

wherein $R_1$, $R_2$, $R_3$ and $R_4$ are, independently of one another, a lower alkyl group having 1 to 5 carbon atoms, particularly preferably a methyl or ethyl group, $R_5$ is hydrogen, or a lower alkyl, benzyl, allyl, acetyl, alkoxyl or benzyloxy group, and "A" is an alkyl, alkoxyl, amino, amide, carboxyl or ester group. "A" may be a group coupled to another hindered amine, such as an ester group of a dicarboxylic acid, for example, malonic acid, adipic acid, succinic acid, sebacic acid, maleic acid or phthalic acid, an ester group of a tricarboxylic acid or tetracarboxylic acid, or an ether group. Further, "A" may be a group having a vinyl group, such as a (meth)acrylate group. In this case, the hindered amine compound may be a polymer having a hindered amine at a side chain.

These compounds are described in Japanese Patent Publication No. 4-34512, and various kinds of compounds may be available from the market. Examples thereof include TINUVIN (trade name) produced by CIBA Specialty Chemicals Co., and ADKSTAB (trade name) produced by Asahi Denka Kogyo K.K. These products are generally available as liquids or solids (powder) insoluble in water, or aqueous dispersions. When the liquid or powdery products are used in recording media for ink-jet, they are turned into aqueous dispersions before use.

<Primary Amine Resin>

The primary amine resin used in the present invention is a compound having a primary amino group, and preferable examples thereof include polymers having a primary amino group at their side chains. Typical examples thereof include homopolymers of aminomethyl (meth)acrylate, aminoethyl (meth)acrylate, aminopropyl (meth)acrylate, aminoethyl (meth)acrylamide, aminopropyl (meth)acrylamide, allylamine, vinylamine and the like, their copolymers with another copolymerizable monomer, and salts thereof. Examples of the salts include, hydrochlorides, sulfates and nitrates. Among these, polyallylamine, polyvinylamine and salts thereof are particularly preferred. Polyallylamine is prepared as a polymer of monoallylamine, and production processes thereof are described in, for example, Japanese Patent Publication Nos. 2-14364, 2-56361, 2-56362, 2-57082 and 2-57083. Polyvinylamine is prepared by hydrolyzing polyvinylformamide, polyvinylacetamide or the like, and production processes thereof are described in, for example, Japanese Patent Application Laid-Open No. 58-23809 and Japanese Patent Publication No. 5-35163. A vinylamine homopolymer completely hydrolyzed and polymers having a vinylamine structure portion partially hydrolyzed and a vinylformamide structure portion and/or a vinylacetamide structure portion are preferably used in the present invention.

<Secondary Amine Resin>

The secondary amine resin used in the present invention is a compound having a secondary amino group, and preferable examples thereof include polymers having a secondary amino group at their main or side chains. Typical examples thereof include homopolymers of N-methylaminomethyl (meth)acrylate, N-methylaminoethyl (meth)acrylate, N-methylamino-propyl (meth)acrylate, N-methylaminoethyl (meth)acrylamide, N-methylaminopropyl (meth)acrylamide, ethylene-imine and diallylamine, their copolymers with another copolymerizable monomer, salts thereof, and polycondensates of dicyanediamide and formaldehyde, polycondensates of epichlorohydrin and formaldehyde and salts thereof. Examples of the salts include, hydrochlorides, sulfates and nitrates. Among these, polyethylene-imine, polydiallylamine, copolymers having a polydiallylamine structure and salts thereof are particularly preferred.

Polyethylene-imine is prepared by subjecting ethylene-imine to ring-opening polymerization in the presence of an acid catalyst such as hydrochloric acid or sulfuric acid. Specific examples and production processes thereof are described in Japanese Patent Publication No. 7-107228 and Japanese Patent Application Laid-Open No. 11-158271. Polyethylene-imine compounds may be available from the market. Examples thereof include EPOMIN (trade name) produced by Nippon Shokubai Kagaku Kogyo Co., Ltd., and POLYMIN (trade name) produced by BASF AG. Those partially modified with urea, ethylene oxide, propylene oxide or the like may be used.

As the diallylamine polymers, polymers of the quaternary ammonium salt type represented by dimethyldiallylammonium chloride such as PAS (trade name) produced by Nitto Boseki Co., Ltd. may be available from the market. On the other hand, homopolymers of the secondary amine type are not well known. Incidentally, diallylamine compounds of the secondary amine type are specifically compounds respectively having such structures as described below.

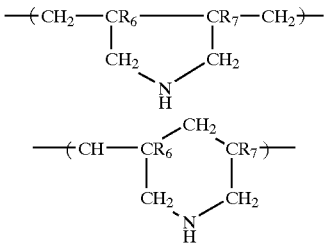

wherein $R_6$ and $R_7$ are, independently of each other, hydrogen or a lower alkyl group such as a methyl or ethyl group.

Preferred examples of the diallylamine polymer used in the present invention may include copolymers of a secondary amine type diallylamine and a monoallylamine. Production processes thereof are described in, for example, Japanese Patent Publication No. 2-56365 and Japanese Patent Registration No. 2,615,681 (Example 2).

Preferred examples of secondary amine resins other than the above resins used in the present invention may include polycondensates of dicyanediamide and formaldehyde. These compounds may also be available from the market, and examples thereof include Sanfix (trade name) produced by Sanyo Chemical Industries, Ltd. Production processes thereof are described in, for example, Japanese Patent Publication Nos. 60-1071 and 36-23231.

The polycondensates of epichlorohydrin and formaldehyde may also be available from the market. As examples thereof, may be mentioned Polyfix (trade name) produced by Showa Highpolymer Co., Ltd.

In the present invention, a preferable molecular weight (number average molecular weight) of the primary amine resin or secondary amine resin is within a range of from 10,000 to 500,000, preferably from 10,000 to 100,000.

From the viewpoint of achieving the fastness properties of the resulting image, a preferable used proportion (by mass) of the hindered amine compound to the primary amine resin or secondary amine resin is within a range of from 10/0.5 to 0.5/10, preferably from 10/1 to 1/5, more preferably from 10/1 to 1/1.

From the viewpoint of gas fastness, good results can be yielded with either the primary amine resin or the secondary amine resin. However, the primary amine resin is more preferred.

In order to provide a recording medium according to the present invention, the above-described two compounds according to the present invention can be turned into a coating formulation for directly coating or impregnating a base material. An ink-receiving layer may also be provided on the base material to contain the above-described two compounds. Such an ink-receiving layer may be prepared by coating the base material with a coating formulation prepared by mixing materials for the ink-receiving layer with the two compounds, and drying it. Alternatively, a coating formulation containing the above-described two compounds may be separately applied to the surface of the ink-receiving layer. In any case, no particular limitation is imposed on the method for the coating or impregnation in the present invention, and any conventionally known coating or impregnating method may be applied as a surface treatment of the recording medium.

When the base material is directly coated or impregnated with the coating formulation to take the structure having the hindered amine compound and the primary or secondary amine resin in the base material or on the surface of the base material, it is only necessary to mix the hindered amine compound with the primary or secondary amine resin to prepare a coating formulation to coat or impregnate the base material with the coating formulation. Coating formulations respectively containing the hindered amine compound and the primary or secondary amine resin may be separately prepared and coated or impregnated. A water-soluble polymer or latex may be mixed into the coating formulation as needed. As examples thereof, may be mentioned polyvinyl alcohol or modified products thereof, starch or modified products thereof, gelatin or modified products thereof, casein or modified products thereof, gum arabic, cellulose derivatives such as carboxymethyl cellulose, hydroxyethyl cellulose and hydroxypropylmethyl cellulose, conjugated diene copolymer latexes such as SBR latexes, NBR latexes and methyl methacrylate-butadiene copolymers, functional-group-modified polymer latexes, vinyl copolymer latexes such as ethylene-vinyl acetate copolymers, polyvinyl pyrrolidone, maleic anhydride polymers or copolymers thereof, acrylic ester copolymers, and the like. As other additives, may be used a dispersing agent, thickener, pH adjuster, lubricant, flowability modifier, surfactant, antifoaming agent, parting agent, fluorescent whitening agent, ultraviolet absorbent, antioxidant and the like. The conventionally known inorganic pigment or organic pigment may also be contained.

The amount of the hindered amine compound and the primary or secondary amine resin coated or impregnated is preferably within a range of from 0.01 to 5 g/m$^2$ in terms of dry coating weight from the viewpoints of recording properties such as image density and ink absorbency.

<Composition of Ink-Receiving Layer>

The ink-receiving layer is composed mainly of a pigment, a binder and other additives. Examples of the pigment include of inorganic pigments such as silica, clay, talc, calcium carbonate, kaolin, aluminum oxides such as alumina and alumina hydrates, and diatomaceous earth, and organic pigments such as urea-formalin resins, ethylene resins and styrene resins. These pigments may be used either singly or in any combination thereof. As preferable examples of the binder, may be mentioned water-soluble polymers and latexes. As specific examples thereof, may be mentioned polyvinyl alcohol or modified products thereof, starch or modified products thereof, gelatin or modified products thereof, casein or modified products thereof, gum arabic, cellulose derivatives such as carboxymethyl cellulose, hydroxyethyl cellulose and hydroxypropylmethyl cellulose, conjugated diene copolymer latexes such as SBR latexes, NBR latexes and methyl methacrylate-butadiene copolymers, functional-group-modified polymer latexes, vinyl copolymer latexes such as ethylene-vinyl acetate copolymers, polyvinyl pyrrolidone, maleic anhydride polymers or copolymers thereof, acrylic ester copolymers, and the like. These binders may be used either singly or in any combination thereof. As the additives, may be used a dispersing agent, thickener, pH adjuster, lubricant, flowability modifier, surfactant, antifoaming agent, parting agent, fluorescent whitening agent, ultraviolet absorbent, antioxidant and the like as needed.

Preferable contents of the pigment, binder and other additives in the ink-receiving layer are as follows:

The content of the pigment is preferably within a range of from 50 to 90% by mass based on the total mass of the ink-receiving layer. The content of the binder is preferably within a range of from 1 to 50% by mass, and the content of the other additives is preferably at most 5% by mass.

A preferable ink-receiving layer of the recording medium for photograph is formed mainly of fine particles having an average particle diameter of at most 1 $\mu$m, preferably at most 0.5 $\mu$m, more preferably not smaller than 0.04 $\mu$m but not higher than 0.3 $\mu$m as the pigment. According to such a recording medium, an image which has high glossiness at the surface thereof, and is high in image density, bright in color tone and high in resolution can be formed. As for the fine particles, fine silica particles or aluminum oxide particles are preferred. As for the fine silica particles, fine silica particles typified by colloidal silica are preferred. The colloidal silica itself may be available from the market. Preferred examples may include those described in, for example, Japanese Patent registration Nos. 2,803,134 and 2,881,847.

As preferable examples of the fine aluminum oxide particles, may be mentioned alumina hydrate particles and γ-type aluminum oxide particles (γ-alumina). As preferable examples of the alumina hydrate particles, may be mentioned alumina hydrates represented by the general formula $$Al_2O_{3-n}(OH)_{2n}.mH_2O \quad (2)$$

wherein n is an integer of 0, 1, 2 or 3, and m is a number of 0 to 10, preferably 0 to 5, with the proviso that m and n are not 0 at the same time. In many cases, $mH_2O$ represents a releasable aqueous phase which does not participate in the formation of a crystal lattice. Therefore, m may take a value other than an integer. When this kind of material is heated, m may reach a value of 0. The alumina hydrate can be generally produced in accordance with the publicly known process such as such hydrolysis of an aluminum alkoxide or sodium aluminate as described in U.S. Pat. Nos. 4,242,271 and 4,202,870, or a process in which an aqueous solution of aluminum sulfate, aluminum chloride or the like is added to an aqueous solution of sodium aluminate to conduct neutralization as described in Japanese Patent Publication No. 57-44605.

Incidentally, Rocek et al. (Collect czech Chem Commun, Vol. 56, pp. 1253–1262, 1991) have reported that the porous structure of an alumina hydrate is affected by a deposition temperature, pH of the solution, aging time and surfactants. Further, As described in literature (Rocek J., et al., Applied Catalysis, Vol. 74, pp. 29–36, 1991), it is generally known that pseudoboehmite among alumina hydrates has both a needle-like form and another form.

The preferred alumina hydrate is free of defects such as cracking and good in coating ability upon formation of the ink-receiving layer, in addition to the achievement of the above-described necessary properties such as transparency, glossiness and fixability of a colorant such as a dye in a recording liquid. An alumina hydrate selected from those produced by the above-described publicly known processes and commercially available products such as Disperal HP 13 (trade name; product of CONDEA Co.) may be used as a component of the ink-receiving layer.

It is known that the crystal structure of aluminum oxide is transformed from aluminum hydroxide of the gibbsite type or boehmite type to aluminum oxide of the γ, σ, η, θ or α type according to the temperature of a heat treatment. From the viewpoints of ink absorbency and transparency of a layer formed, aluminum oxide (γ-alumina) of the γ crystal structure type is preferred in addition to the alumina hydrate particles.

The BET specific surface area of the fine aluminum oxide particles is preferably within a range of from 100 to 160

$m^2/g$. If the BET specific surface area exceeds 160 $m^2/g$, the ink absorbency of the resulting ink-receiving layer may be deteriorated in some cases though it varies according to the particle size of the pigment. If the BET specific surface area is smaller than 100 $m^2/g$, lowering of color density may occur in some cases due to scattering of light.

The mixing ratio by mass of such a pigment to the binder may be optionally selected from a range of preferably from 1:1 to 100:1, more preferably from 5:1 to 25:1. When the amount of the binder is controlled within the above range, the mechanical strength of the resulting ink-receiving layer can be more enhanced, and so occurrence of cracking and dusting upon the formation of the ink-receiving layer can be prevented, and a more preferable pore volume can be retained in the ink-receiving layer.

The content of the fine aluminum oxide particles or fine silica particles in the ink-receiving layer is preferably at least 50% by weight, more preferably at least 70% by weight, most preferably not lower than 80% by weight but not higher than 99% by weight.

In addition to the above-described fine particles, particles of the conventionally known inorganic pigment, organic pigment or the like may be contained in the ink-receiving layer. In the present invention, the ink-receiving layer is preferably formed by the fine particles in an amount of at least 90% by mass based on all particles.

A coating weight of the ink-receiving layer is preferably at most 30 $g/m^2$, more preferably 20 to 30 $g/m^2$, particularly preferably 10 to 30 $g/m^2$ in terms of dry solids for more improving the fixability of a colorant component such as a dye in a recording liquid and the smoothness of the resulting ink-receiving layer.

The content of the hindered amine compound in the ink-receiving layer is preferably within a range of from 0.1 to 15% by mass based on the solids in the ink-receiving layer. When at least two ink-receiving layers are provided, the content of the hindered amine compound is preferably within the above range in the uppermost layer, or within a range of from 0.01 to 10 $g/m^2$ in the whole recording medium. If the content is lower than the lower limit of the above range, the color-fading-preventing effect thereof may be deteriorated in some cases. If the content is higher than the upper limit of the above range, the lowering of image density and ink absorbency may occur in some cases.

When a structure having the hindered amine compound and the primary or secondary amine resin separately on the ink-receiving layer is taken, it is only necessary to mix these compounds to prepare a coating formulation to coat the ink-receiving layer with the coating formulation. Coating formulations respectively containing the hindered amine compound and the primary or secondary amine resin may be separately prepared and coated. A water-soluble polymer or latex may be mixed into the coating formulation as needed. As examples thereof, may be mentioned polyvinyl alcohol or modified products thereof, starch or modified products thereof, gelatin or modified products thereof, casein or modified products thereof, gum arabic, cellulose derivatives such as carboxymethyl cellulose, hydroxyethyl cellulose and hydroxypropylmethyl cellulose, conjugated diene copolymer latexes such as SBR latexes, NBR latexes and methyl methacrylate-butadiene copolymers, functional-group-modified polymer latexes, vinyl copolymer latexes such as ethylene-vinyl acetate copolymers, polyvinyl pyrrolidone, maleic anhydride polymers or copolymers thereof, acrylic ester copolymers, and the like. As other additives, may be used a dispersing agent, thickener, pH adjuster, lubricant, flowability modifier, surfactant, antifoaming agent, parting agent, fluorescent whitening agent, ultraviolet absorbent, antioxidant and the like. The conventionally known inorganic pigment or organic pigment may also be contained.

In this case, the coating weight of the hindered amine compound and the primary or secondary amine resin is preferably within a range of from 0.01 to 5 $g/m^2$ in terms of dry coating weight from the viewpoints of recording properties such as image density and ink absorbency.

<Base Material>

No particular limitation is imposed on the base material used in the present invention, and any base material may be used so far as it can be utilized as a base material for a recording medium to which a recording liquid is apply to conduct recording. Examples thereof include those having a structure at least having a fibrous base composed mainly of wood pulp and a filler, such as suitably sized paper and non-sized paper, and various kinds of plastic films such as polyethylene terephthalate films. In order to achieve high glossiness in the present invention, it is preferable to use a base material having a surface layer coated with an inorganic pigment containing at least barium sulfate together with the binder.

The image-quality properties comparable with a silver salt photograph are achieved by the fact that the surface layer containing barium sulfate has a very high reflectance due to its high whiteness degree and refractive index, and moreover an ink-receiving layer having very high transparency is formed on the surface layer. The whiteness degree and Bekk smoothness of the surface layer containing barium sulfate are preferably preset in such a manner that the whiteness degree and Bekk smoothness on the side of the ink-receiving layer in the finally resulting recording medium be at least 87% and at least 400 seconds, respectively.

<Forming Process of Ink-receiving Layer>

In the recording medium having the ink-receiving layer according to the present invention, as a process for forming the ink-receiving layer on the base material, may be used a process comprising preparing a coating formulation containing the materials described above, coating the base material with the coating formulation by means of a coating device and drying it. No particular limitation is imposed on the coating method, and a generally-used coating technique making use of a blade coater, air knife coater, roll coater, curtain coater, bar coater, gravure coater, die coater, sprayer or the like may be used. Further, as a process for forming the ink-receiving layer of the recording medium for photograph, may be mentioned a process comprising coating the base material with a coating formulation containing the fine particles by the same coating method as described above and then subjecting the coated surface to a gloss treatment.

<Gloss Treatment>

As the gloss treatment on the side of the ink-receiving layer in the present invention, may be suitably used a cast process comprising pressing a substance to be treated in a wet state against a specular drum the surface of which has been heated. Methods for the cast treatment include a direct method, gelling method and rewet method. Of these, the direct method is a method in which the surface of an ink-receiving layer coated on a base material upon the formation of the ink-receiving layer is pressed against the heated specular drum while the ink-receiving layer is still in a wet state, followed by conducting a drying treatment. The gelling method is a method in which an ink-receiving layer coated on a base material upon the formation of the ink-receiving layer is brought into contact with a gelling agent bath while the ink-receiving layer is still in a wet state, thereby making it a gelled state, and the surface of this layer is pressed against the heated specular drum to conduct a drying treatment. The rewet method is particularly preferred in the present invention. In the rewet method, a coating formulation for forming the ink-receiving layer is applied to a base material and dried by a method known per se in the art, thereby once forming a layer to become the receiving layer. Thereafter, the layer is treated again with hot water or the like to put the ink-receiving layer back into a wet state, and the surface of the ink-receiving layer in the wet state is pressed against the heated specular drum to conduct a drying treatment. The surface of the ink-receiving layer is pressed against the heated specular drum in the wet state, whereby high gloss can be imparted to the surface while retaining the porous structure of the ink-receiving layer. When the ink-receiving layer in the wet state is pressed against the heated specular drum to dry it, the ink-receiving layer once dried to form a layer is wetted again, so that evaporation of water from the back side of the layer can complete with a small amount. Therefore, this method has little limitation on the base material used, and so the gloss treatment can be conducted even when the ink-receiving layer is provided on a dense base material.

The glossiness of a surface on the side of the ink-receiving layer of the thus-obtained recording medium according to the present invention can be controlled so as to be at least 20% as measured at 20°. Such control is preferred in that the formation of a high-quality image becomes feasible in ink-jet recording. The glossiness in the present invention is a value measured in accordance with the method prescribed in JIS Z 8741.

<Ink>

Inks which are recording liquids used in the present invention comprise coloring matter for forming an image and a liquid medium dissolving or dispersing the coloring matter therein as essential components and are prepared by adding various kinds of dispersing agents, surfactants, viscosity modifiers, specific resistance adjusters, pH adjusters, mildewproofing agents, dissolution (or dispersion) stabilizers for recording agents, etc. to these components as needed.

Examples of the recording agents used in the inks include direct dyes, acid dyes, basic dyes, reactive dyes, food colors, disperse dyes, oil-soluble dyes and various kinds of pigments, and the conventionally known recording agents may be used without any particular limitation. The content of such coloring matter is determined depending on the type of the liquid medium component, properties required of the resulting inks, etc. It is generally used in a proportion of about 0.1 to 20% by mass in the conventional inks. Accordingly, in the present invention, it may also be used in the same proportion as described above.

As examples of the liquid medium dissolving or dispersing such coloring matter as described above therein in the inks used in the present invention, may be mentioned water, and mixed solvents composed of water and a water-soluble organic solvent, with the mixed solvents composed of water and a water-soluble organic solvent being particularly preferred, which comprise a water-miscible glycol or glycol ether having a preventive effect on drying of the resulting ink as the water-soluble organic solvent.

Examples of the water-soluble organic solvents used in the inks according to the present invention include alkyl alcohols such as methanol, ethanol, isopropyl alcohol and n-butanol; amides such as dimethylformamide and dimethylacetamide; ketones and keto alcohols such as acetone and acetone alcohol; alkylene glycols such as ethylene glycol, propylene glycol, triethylene glycol, thiodiglycol, diethylene glycol and polyethylene glycol; 1,2,6-hexanetriol; glycerols; alkyl ethers of polyhydric alcohols, such as (di) ethylene glycol monomethyl (monoethyl) ether and triethylene glycol monomethyl (dimethyl) ether; sulfolane; N-methyl-2-pyrrolidone; and 1,3-dimethyl-2-imidazolidinone. One or more of these solvents may be used.

The inks according to the present invention are prepared by using the materials described above and further adding a surfactant and the like as needed.

<Ink-jet Recording Process>

As an ink-jet recording process preferred as the image forming process according to the present invention, any system may be used so far as it can effectively eject an ink from a nozzle to apply it to a recording medium which is a target for ejection. In particular, an ink-jet recording system described in Japanese Patent Application Laid-Open No. 54-59936, in which an ink undergoes a rapid volumetric change by an action of thermal energy applied to the ink, so that the ink is ejected from a nozzle by the working force generated by this change of state, may be used effectively.

Figure 2:
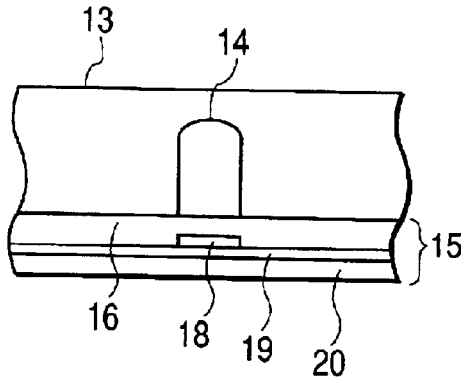
FIG. 2 is a transverse cross-sectional view taken along the line 2—2 of the head of the ink-jet recording apparatus shown in FIG. 1.
Figure 3:
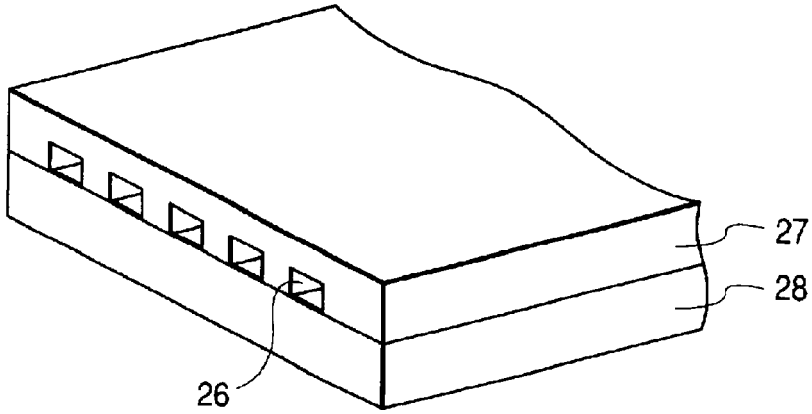
FIG. 3 is a perspective view of an appearance of a multi-head composed of an array of a number of heads as shown in FIG. 1.

An exemplary ink-jet recording apparatus preferably used in the ink-jet recording process according to the present invention will hereinafter be described. Examples of the construction of a head, which is a main component of the ink-jet recording apparatus, are illustrated in FIGS. 1, 2 and 3. FIG. 1 is a cross-sectional view of the head 13 taken along an ink flow path, and FIG. 2 is a cross-sectional view taken along the line 2—2 in FIG. 1.

The head 13 is formed by bonding a glass, ceramic, silicon or plastic plate or the like having a groove 14 through which an ink is passed, to a heating head 15 used in thermal recording (the drawings show a head to which, however, the invention is not limited). The heating head 15 is composed of a protective film 16 formed of silicon oxide or the like, aluminum electrodes 17-1 and 17-2, a heating resistor layer 18 formed of nichrome or the like, a heat accumulating layer 19, and a substrate 20 made of alumina or the like having a good heat radiating property.

An ink 21 comes up to an ejection orifice (a minute opening) 22 and forms a meniscus 23 due to a pressure P.

Now, upon application of electric signals to the electrodes 17-1, 17-2, the heating head 15 rapidly generates heat at the region shown by "n" to form bubbles in the ink 21 which is in contact with this region. The meniscus 23 of the ink is projected by the action of the pressure thus produced, and the ink 21 is ejected from the ejection orifice 22 to a recording sheet 25 in the form of ink droplets 24. FIG. 3 illustrates an appearance of a multi-head composed of an array of a number of heads as shown in FIG. 1. The multi-head is formed by closely bonding a glass plate having a number of grooves to a heating head similar to the heating head illustrated in FIG. 1.

Figure 4:
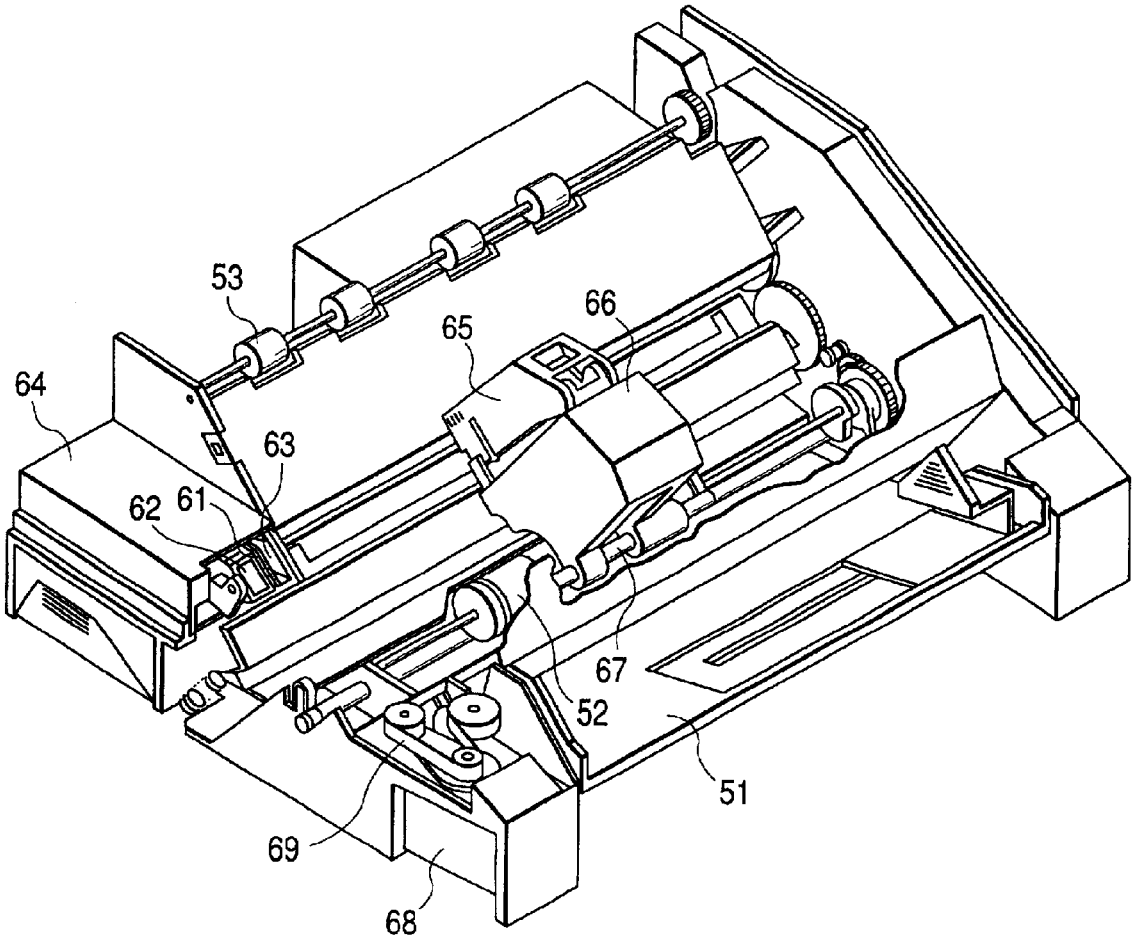
FIG. 4 is a perspective view of an exemplary ink-jet recording apparatus.

FIG. 4 illustrates an example of an ink-jet recording apparatus in which such a head has been incorporated. In FIG. 4, reference numeral 61 designates a blade serving as a wiping member, one end of which is a stationary end held by a blade-holding member to form a cantilever. The blade 61 is provided at the position adjacent to the region in which a recording head 65 operates, and in this embodiment, is held in such a form that it protrudes into the course through which the recording head 65 is moved. Reference numeral 62 indicates a cap, which is provided at the home position adjacent to the blade 61, and is so constituted that it moves in the direction perpendicular to the direction in which the recording head 65 is moved and comes into contact with the face of ejection openings to cap it. Reference numeral 63 denotes an absorbing member provided adjoiningly to the blade 61 and, similar to the blade 61, held in such a form that it protrudes into the course through which the recording head 65 is moved. The above-described blade 61, cap 62 and absorbing member 63 constitute an ejection-recovery portion 64, where the blade 61 and absorbing member 63 remove water, dust and/or the like from the face of the ink-ejecting openings.

Reference numeral 65 designates the recording head having an ejection-energy-generating means and serving to eject the ink onto the recording medium set in an opposing relation to the ejection opening face provided with ejection openings to conduct recording. Reference numeral 66 indicates a carriage on which the recording head 65 is mounted so that the recording head 65 can be moved. The carriage 66 is slidably interlocked with a guide shaft 67 and is connected (not illustrated) at its part to a belt 69 driven by a motor 68.Thus, the carriage 66 can be moved along the guide shaft 67 and hence, the recording head 65 can be moved from a recording region to a region adjacent thereto.

Reference numerals 51 and 52 denote a feeding part from which the recording media are separately inserted, and feed rollers driven by a motor (not illustrated), respectively. With such a construction, the recording medium is fed to thepo-sition opposite to the ejection opening face of the recording head 65, and discharged from a discharge section provided with discharge rollers 53 with the progress of recording.

In the above construction, the cap 62 in the head recovery portion 64 is receded from the path of motion of the recording head 65 when the recording head 65 is returned to its home position, for example, after completion of recording, and the blade 61 remains protruded into the path of motion. As a result, the ejection opening face of the recording head 65 is wiped. When the cap 62 comes into contact with the ejection opening face of the recording head 65 to cap it, the cap 62 is moved so as to protrude into the path of motion of the recording head 65.

When the recording head 65 is moved from its home position to the position at which recording is started, the cap 62 and the blade 61 are at the same positions as the positions for the wiping as described above. As a result, the ejection opening face of the recording head 65 is also wiped at the time of this movement.

The above movement of the recording head 65 to its home position is made not only when the recording is completed or the recording head 65 is recovered for ejection, but also when the recording head 65 is moved between recording regions for the purpose of recording, during which it is moved to the home position adjacent to each recording region at given intervals, where the ejection opening face is wiped in accordance with this movement.

The present invention will hereinafter be described more specifically by the following EXAMPLES and COMPARATIVE EXAMPLES. Incidentally, all designations of "part" or "parts" and "%" as will be used in the following examples mean part or parts by mass and % by mass unless expressly noted.

[Preparation of Hindered Amine Compound Emulsion]

The preparation of a hindered amine compound emulsion was conducted in accordance with roughly divided two processes according to the form of a hindered amine compound used at normal temperature.

(A) Hindered Amine Compound Liquid in Normal Temperature:

Twenty parts of a nonionic surfactant (Naloacty N-85, trade name, product of Sanyo Chemical Industries, Ltd.) were added to 100 parts of each of hindered amine compounds belonging to the following Group (A), and the mixture was stirred until it became uniform. Thereafter, 130 parts of ion-exchanged water were gradually added dropwise with stirring to prepare O/W type Emulsions (A-1 to A-4) utilizing phase reversal of emulsion. In each emulsion, the concentration of the hindered amine compound was 40%.

(B) Hindered Amine Compound Solid in Normal Temperature:

Fifteen parts of each of hindered amine compounds belonging to the following Group (B) and 20 parts of a nonionic surfactant (Naloacty N-85, trade name, product of Sanyo Chemical Industries, Ltd.) were added to 85 parts of ethyl acetate, and the mixture was stirred until it became uniform. Thereafter, 82.5 parts of ion-exchanged water were gradually added dropwise with stirring to prepare O/W type Emulsions (B-1 to B-8) utilizing phase reversal of emulsion. In each emulsion, the concentration of the hindered amine compound was 8%.

Specific structural formulae of the respective compounds are shown in Tables 1 and 2.

Group (A) Hindered Amine Compound Liquid in Normal Temperature:

A-1. TINUVIN 123 (trade name, product of CIBA Specialty Chemicals Co.)

A-2. TINUVIN 292 (trade name, product of CIBA Specialty Chemicals Co.)

A-3. ADKSTAB LA-62 (trade name, product of Asahi Denka Kogyo K.K.)

A-4. ADKSTAB LA-67 (trade name, product of Asahi Denka Kogyo K.K.)

Group (B) Hindered Amine Compound Solid in Normal Temperature:

B-1. TINUVIN 622LD (trade name, product of CIBA Specialty Chemicals Co.)

B-2. CHIMASSORB 119 (trade name, product of CIBA Specialty Chemicals Co.)

B-3. TINUVIN 770 (trade name, product of CIBA Specialty Chemicals Co.)

B-4. ADKSTAB LA-52 (trade name, product of Asahi Denka Kogyo K.K.)

B-5. ADKSTAB LA-57 (trade name, product of Asahi Denka Kogyo K.K.)

B-6. ADKSTAB LA-63P (trade name, product of Asahi Denka Kogyo K.K.)

B-7. ADKSTAB LA-68LD (trade name, product of Asahi Denka Kogyo K.K.)

B-8. Polymer having a hindered amine at its side chain.

[Synthesis Example of Polymer B-8 having a Hindered Amine at its Side Chain]

A four-necked flask equipped with a stirrer, thermometer, reflux condenser and nitrogen inlet tube was charged with 20 parts of 1,2,2,6,6-pentamethyl-4-piperidyl methacrylate (ADKSTAB LA-82, trade name, product of Asahi Denka Kogyo K.K.) and 80 parts of ethyl acetate. After purging the interior of the system with nitrogen, the contents were heated to 70° C. One hundred parts of ethyl acetate in which 0.05 parts of 2,2'-azobisisobutylnitrile had been dissolved were then gradually added to initiate a reaction. While keeping the system at 70° C., polymerization was conducted for 8 hours. Thereafter, about 100 parts of ethyl acetate were distilled off, and the residual polymer solution was cooled and then poured into 500 parts of hexane to precipitate a polymer formed. After filtration, the resultant polymer was dried under reduced pressure to obtain about 12 parts of a polymer of 1,2,2,6,6-pentamethyl-4-piperidyl methacrylate. The molecular weight thereof was 80,000 in terms of Mw of standard polystyrene.

TABLE 1

| Group (A): Hindered amine compound liquid in normal temperature |
|---|
| A-1 TINUVIN 123 |
| A-2 Tinuvin 292 |
| A-3 LA-62 (R: —$CH_3$) |
| A-4 LA-67 (R: —H) |

TABLE 2

| Group (B): Hindered amine compound solid in normal temperature |
|---|
| B-1 TINUVIN 622 LD |
| B-2 CHIMASSORB 119 |

TABLE 2-continued

| Group (B): Hindered amine compound solid in normal temperature | |
|---|---|
| B-3 TINUVIN 770 | 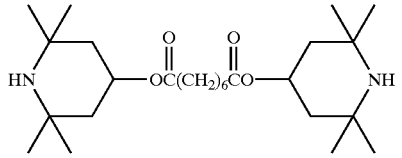 |
| B-4 LA-52 | 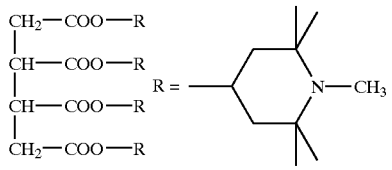 |
| B-5 LA-57 | 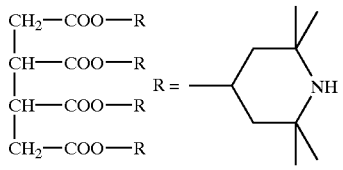 |
| B-6 LA-63P (R: —$CH_3$) | 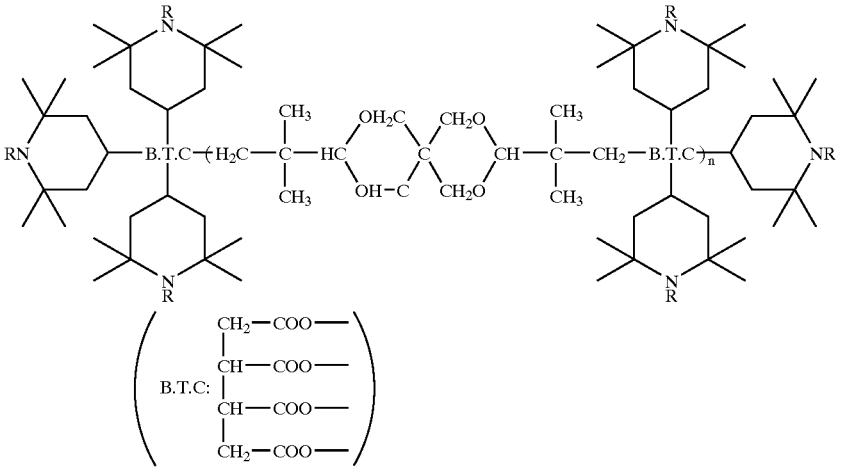 |
| B-7 LA-68LD (R: —H) | |

[Synthesis Examples of Primary Amine Resin) Synthesis Example of Poly(2-aminoethyl Methacrylate] (C-1):

A four-necked flask equipped with a stirrer, thermometer, reflux condenser and nitrogen inlet tube was charged with 100 parts of a 60% aqueous solution of isopropyl alcohol. After purging the interior of the system with nitrogen, the contents were slowly heated to reflux them. One hundred parts of a 60% aqueous solution of isopropyl alcohol containing 25 parts of 2-aminoethyl methacrylate hydrochloride (product of Aldrich Co.) and 0.4 parts of 2,2'-azobisisobutylnitrile were then added dropwise over 2 hours to conduct polymerization. Thereafter, the reaction mixture was heated for 3 hours under reflux, and 100 parts of water were added to dilute the reaction mixture. Isopropyl alcohol was then distilled off to adjust the concentration of the reaction mixture, thereby obtaining an aqueous solution containing 15% of solids. The molecular weight of the polymer thus obtained was 45,000 in terms of Mw of standard polyethylene glycol.

Synthesis Example of Polyallylamine salt (C-2):

After polyallylamine hydrochloride was prepared from monoallylamine in accordance with the process described in Example of Japanese Patent Publication No. 2-57083, the concentration thereof was adjusted to obtain polyallylamine hydrochloride as a 10% aqueous solution. The molecular weight of the polymer thus obtained was 10,000.

Synthesis Example of Polyvinylamine salt (C-3):

After N-vinylformamide was polymerized in accordance with the process described in Example of Japanese Patent Publication No. 5-35163, hydrolysis was conducted, and the concentration of a formed product was further adjusted to obtain polyvinylamine as a 10% aqueous solution. The pH of the resultant solution was adjusted to 7 with concentrated hydrochloric acid. The rate of hydrolysis and the molecular weight of the polymer thus obtained were respectively 59% and 70,000.

[Example of Comparative Compound]

Quaternary Ammonium Compound (C-4):

As a commercially available compound having a quaternary ammonium salt group, a polymer of dimethyldiallylammonium chloride described in Japanese Patent Application Laid-Open No. 59-20696 was used as a comparative compound.

[Preparation Example of Alumina Hydrate Sol]

Disperal (trade name; product of CONDEA Co.) as alumina hydrate was mixed into purified water to prepare a dispersion containing 5% by weight of solids. Hydrochloric acid was then added to this dispersion to adjust the pH of the dispersion to 4, and the thus-adjusted dispersion was stirred for a while. Thereafter, the dispersion was heated to 95° C. with stirring and kept for 3 hours at this temperature. The pH of the dispersion was adjusted to 10 with caustic soda, and the thus-adjusted dispersion was kept for 10 hours with stirring. After 10 hours, the temperature of the dispersion was returned back to room temperature, and its pH was adjusted to 7 to 8. Thereafter, a desalting treatment was conducted, and acetic acid was then added to conduct a deflocculating treatment, thereby obtaining colloidal sol. An alumina hydrate according to the present invention obtained by drying this colloidal sol was analyzed by X-ray diffractiometry and found to have a pseudoboehmite structure. The average particle diameter of the alumina hydrate was at most 0.1 $\mu$m.

[Preparation Example of Recording Medium: Composition I of Ink-receiving Layer]

(Preparation Example I of Coating Formulation)

Completely saponified polyvinyl alcohol (PVA117, trade name, product of Kuraray Co., Ltd.) was dissolved in ion-exchanged water to obtain a 9% aqueous solution. The colloidal sol of the alumina hydrate prepared in the above-described Preparation Example was concentrated to prepare a 17% sol. The colloidal sol of the alumina hydrate and the polyvinyl alcohol solution were mixed and stirred so as to give a mixing ratio of 10:1 in terms of solids, thereby obtaining a dispersion.

The dispersion, the primary amine resin solution and the hindered amine compound emulsion were mixed and stirred to prepare a coating formulation. The primary amine resin and hindered amine compound used and their proportions used are shown in Table 3. The proportions used were expressed by the mass ratios of the respective compounds to 100 parts, in terms of solids, of the alumina hydrate.

(Production of Recording Medium)

Each coating formulation prepared above was applied to a baryta layer of a base material (Bekk smoothness: 420 seconds, whiteness degree: 89%) having the baryta layer by a die coater so as to give a dry coating thickness of 30 g/m$^2$. The base material used at this time was obtained by coating a fibrous base having a basis weight of 150 g/m$^2$ and a Stokigt sizing degree of 200 seconds with a baryta composition composed of 100 parts of barium sulfate and 10 parts of gelatin so as to give a dry coating mass of 30 g/m$^2$ and subjecting it to a calendering treatment. A layer for forming an ink-receiving layer was formed on the base material having the baryta layer in this manner. The surface of the layer for forming an ink-receiving layer was subjected to a rewet cast treatment with hot water (80° C.) using a rewet cast coater, thereby obtaining Recording Media 1 to 8 and 12 according to the present invention and comparative Recording Media 13 to 19. The recording surfaces of the recording media thus produced all had high surface glossiness. The recording media obtained above were evaluated in accordance with the following respective methods. The results are shown in Table 3.

(Fastness Test 1)

Recorded articles produced by the following method were used to conduct various fastness tests against images in accordance with the following methods (1) to (3).

Production of Recorded Article:

A photoprinter (BJ-F870, trade name, manufactured by Canon Inc.) using an ink-jet system was used to print solid patches of black, cyan, magenta, yellow, composite black, leaf green, flesh color and sky blue on the recording surface of each of the recording media produced above, and a patch having an optical density (O.D.) of 1.0 as to each color was used in each test. Evaluation method of light fastness and gas fastness:

The image densities of each of the recorded articles before and after the test were measured by means of a spectrophotometer, Spectrolino (trade name, manufactured by Gretag Macbeth Co.). The evaluation as to the light fastness and gas fastness was judged in accordance with the following standards. The results are shown in Table 3.

Testing Methods:

(1) Light Fastness Test 1:

An exposure test as to light fastness was conducted by means of a xenon fadeometer in accordance with the following test conditions. This test is a fastness test against an image in view of the influence of sunlight through a window in a room. Test conditions:

Exposure dose: 70 klux

Test time: 100 hours

Temperature and humidity in a test chamber: 24° C., 60% RH

Filter: (outer) soda lime; (inner) borosilicate.

Evaluation of Light Fastness:

The light fastness was evaluated in the following manner on the basis of density retention data after the exposure test as to light fastness by reference to the standard in ISO 10977 (1993).

A: The density retention was at least 90%, and a difference in density retention between respective component colors in a composite color was within 5%;

B: The density retention was 80 to 89%, and a difference in density retention between respective component colors in a composite color was within 10%;

C: The density retention was lower than 80%, or a difference in density retention between respective component colors in a composite color was at least 15%.

(2) Light Fastness Test 2:

An exposure test as to light fastness was conducted by means of a fluorescent lamp light fastness tester in accordance with the following test conditions. This test is a fastness test against an image in view of the influence of light from a fluorescent lamp in a room.

Test conditions:

Exposure dose: 70 klux

Test time: 240 hours

Temperature and humidity in a test chamber: 24° C., 60% RH

Filter: soda lime.

Evaluation of Light Fastness:

The light fastness was evaluated in the following manner on the basis of density retention data after the exposure test as to light fastness by reference to the standard in ISO 10977 (1993).

A: The density retention was at least 90%, and a difference in density retention between respective component colors in a composite color was within 5%;

B: The density retention was 80 to 89%, and a difference in density retention between respective component colors in a composite color was within 10%;

C: The density retention was lower than 80%, or a difference in density retention between respective component colors in a composite color was at least 15%.

(3) Gas Fastness Test:

An exposure test as to gas fastness was conducted by means of a gas corrosion tester in accordance with the following test conditions (ANSI/ISA-S71.04-1985). This test is a fastness test against an image in view of the influence of various gases in a room.

Test Conditions:

Exposure gas composition: $H_2S$ 10 ppb, $SO_2$ 100 ppb, $NO_2$ 125 ppb, $Cl_2$ 2 ppb, $O_2$25 ppb Test time: 168 hours Temperature and humidity in a test chamber: 24° C., 60% RH.

Evaluation of Gas Fastness:

The gas fastness was evaluated in the following manner by density retention data after the exposure test as to gas fastness and visual judgment.

A: The density retention was at least 80%, and no change in color tone was observed compared with that before the test;

B: The density retention was 70 to 80%, and color tone was slightly changed compared with that before the test;

C: The density retention was lower than 70%, the color tone was clearly changed to another color tone compared with that before the test.

(Fastness Test 2: Yellowing Test)

Testing Method and Evaluating Method:

An unprinted recording medium was used to conduct a test. The recording medium was left to stand in the following environment to compare tints of the recording surface before and after the test with each other. The results are shown in Table 3.

Test Conditions:

Temperature and humidity in a test chamber: 50° C., 80% RH

Test time: 240 hours.

[Preparation Example of Recording Medium: Composition II of Ink-receiving Layer]

(Preparation Example II of Coating Formulation)

A coating formulation was prepared in the same manner as in Preparation Example I of Coating Formulation except that alumina hydrate sol prepared in the following manner was used as the alumina hydrate sol. Similar to Preparation Example I, the primary amine resin and hindered amine compound used and their proportions used are shown in Table 3.

Preparation Example 2 of Alumina Hydrate:

Aluminum dodeoxide was prepared in accordance with the process described in U.S. Pat. No. 4,242,271. The aluminum dodeoxide was then hydrolyzed in accordance with the process described in U.S. Pat. No. 4,202,870 to prepare an alumina slurry. Water was added to the alumina slurry until the solids content of the alumina hydrate reached 7.9%. A 3.9% nitric acid solution was added to this slurry to adjust the pH of the slurry to 6.8, and the slurry was aged at 50° C. for 5 days, thereby preparing a colloidal sol of the alumina hydrate. An alumina hydrate according to the present invention obtained by drying this colloidal sol was analyzed by X-ray diffractiometry and found to have a pseudoboehmite structure. The average particle diameter of the alumina hydrate was at most 0.1 μm.

(Production of Recording Medium)

The coating formulation prepared above was applied by die coating onto a white polyester film (Lumirror, trade name, product of Toray Industries, Inc.) having a thickness of 100 μm to form an ink-receiving layer having a thickness of 30 μm, thereby obtaining Recording Medium 9 according to the present invention and comparative Recording Medium 20. The recording surfaces of the recording media thus produced both had a high surface glossiness.

[Preparation Example of Recording Medium: Composition III of Ink-receiving Layer]

(Preparation Example III of Coating Formulation)

A coating formulation was prepared in the same manner as in Preparation Example I of Coating Formulation except that colloidal silica prepared in the following manner was used in place of the alumina hydrate sol. Similar to Preparation Example I, the primary amine resin and hindered amine compound used and their proportions used are shown in Table 3.

Preparation Example of Colloidal Silica:

Colloidal silica particles mutually bonded in the form of a chain were prepared in accordance with the process described in Example 1 of Japanese Patent Registration No. 2803134. The average particle diameter thereof was at most 0.1 μm.

(Production of Recording Medium)

The coating formulation prepared above was applied by die coating onto a white polyester film (Lumirror, trade name, product of Toray Industries, Inc.) having a thickness of 100 μm to form an ink-receiving layer having a thickness of 30 μm, thereby obtaining Recording Medium 10 according to the present invention and comparative Recording Medium 21. The recording surfaces of the recording media thus produced both had a high surface glossiness.

[Preparation Example of Recording Medium: Composition IV of Ink-receiving Layer]

(Preparation Example IV of Coating Formulation)

Ten parts of commercially available synthetic silica (Finesil, trade name, product of Tokuyama, Soda Co., Ltd.; average particle diameter: 2.8 μm) were added to 90 parts of ion-exchanged water to obtain a dispersion of the silica by means of a homogenizer. Completely saponified polyvinyl alcohol (PVA117, trade name, product of Kuraray Co., Ltd.) was dissolved in purified water to obtain a 10% aqueous solution. The silica dispersion prepared above and the polyvinyl alcohol solution were mixed and stirred so as to give a mixing ratio of 2:1 in terms of solids, thereby obtaining a dispersion.

The dispersion, the primary amine resin solution and the hindered amine compound emulsion were mixed and stirred to prepare a coating formulation. The primary amine resin and hindered amine compound used and their proportions used are shown likewise in Table 3. The proportions used were expressed by the mass ratios of the respective compounds to 100 parts, in terms of solids, of the silica.

(Production of Recording Medium)

The coating formulation prepared above was applied by means of a bar coater onto woodfree paper having a sizing degree of 25 seconds and a basis weight of 80 g/m$^2$ so as to give a dry coating weight of 15 g/m$^2$, and the surface thereof was subjected to a supercalendering treatment, thereby obtaining Recording Medium 11 according to the present invention and Comparative Recording Medium 22, which had a matte recording surface.

The thus-obtained Recording Media 9 to 11 and 20 to 22 were also evaluated in the same manner as in Example 1. The results are shown in Table 3.

TABLE 3

| | Recording medium No. | Composition of ink-receiving layer | Hindered amine | | Primary amine resin | | | Quaternary ammonium salt compound: | Proportion used (to 100 parts of alumina hydrate or silica) | | Evaluation result of fastness properties of image | | | |
|---|---|---|---|---|---|---|---|---|---|---|---|---|---|---|
| | | | A | B | C-1 | C-2 | C-3 | C-4 | Hindered amine | Amine resin | Xenon light fastness | Fluorescent light fastness | Gas fastness | Yellowing |
| Ex. 1 | 1 | I | A-1 | | ○ | | | | 5 | 2 | A | A | A | Not changed |
| Ex. 2 | 2 | I | A-2 | | | ○ | | | 4 | 1 | B | B | B | Not changed |
| Ex. 3 | 3 | I | A-3 | | | | ○ | | 5 | 2 | A | A | A | Not changed |
| Ex. 4 | 4 | I | A-4 | | | | ○ | | 6 | 3 | A | A | A | Not changed |
| Ex. 5 | 5 | I | | B-1 | ○ | | | | 5 | 1 | A | A | B | Not changed |
| Ex. 6 | 6 | I | | B-2 | | ○ | | | 4 | 2 | B | B | A | Not changed |
| Ex. 7 | 7 | I | | B-3 | | ○ | | | 5 | 1 | B | B | B | Not changed |
| Ex. 8 | 8 | I | | B-4 | | ○ | | | 6 | 2 | B | B | A | Not changed |
| Ex. 9 | 9 | II | | B-5 | | | ○ | | 5 | 3 | A | A | A | Not changed |
| Ex. 10 | 10 | III | | B-6 | | | ○ | | 4 | 1 | A | A | B | Not changed |
| Ex. 11 | 11 | IV | | B-7 | | | ○ | | 7 | 2 | A | A | A | Not changed |
| Ex. 12 | 12 | I | | B-8 | | | ○ | | 4 | 1 | A | A | B | Not changed |
| Comp. Ex. 1 | 13 | I | | | | | | | 0 | 0 | C | C | C | Not changed |
| Comp. Ex. 2 | 14 | I | A-1 | | | | | | 5 | 0 | B | B | C | Not changed |
| Comp. Ex. 3 | 15 | I | | B-3 | | | | | 5 | 0 | B | B | C | Not changed |
| Comp. Ex. 4 | 16 | I | | B-1 | | | | ○ | 5 | 2 | C | C | C | Yellowed |
| Comp. Ex. 5 | 17 | I | A-3 | | | | | ○ | 6 | 3 | C | C | C | Yellowed |
| Comp. Ex. 6 | 18 | I | | | | ○ | | | 0 | 3 | C | C | B | Yellowed |
| Comp. Ex. 7 | 19 | I | | | | | ○ | | 0 | 5 | C | C | A | Yellowed |
| Comp. Ex. 8 | 20 | II | | | | | | | 0 | 0 | B | B | C | Not changed |
| Comp. Ex. 9 | 21 | III | | | | | | | 0 | 0 | B | B | C | Not changed |
| Comp. Ex. 10 | 22 | IV | | | | | | | 0 | 0 | B | B | C | Yellowed |

[Synthesis Examples of Secondary Amine Resin]

Synthesis Example of Polyethylene Imine) (D-1):

Polyethylene-imine low in a branching degree (high in content of secondary amino group compared with tertiary amino group) was obtained in accordance with the process described in Example of Japanese Patent Application Laid-Open No. 11-158271. The molecular weight (number average) of the polymer thus obtained was 3,000.

Synthesis Example of Copolymer (D-2) of Diallylamine and Acrylamide:

After a copolymer of diallylamine and acrylamide was prepared in accordance with the process described in Example 2 of Japanese Patent Registration No. 2615681, the concentration thereof was adjusted to obtain a 10% aqueous solution of the copolymer of diallylamine and acrylamide. The molecular weight (number average) of the polymer thus obtained was 10,000.

Synthesis Example of Polycondensate (D-3) of Dicyanediamide-formaldehyde:

A polycondensate of dicyanediamide and formaldehyde was obtained in accordance with the process described in Referential Example of Japanese Patent Publication No. 60-1071.

[Preparation Example of Recording Medium: Composition I-2 of Coating Layer]

(Preparation Example I-2 of Coating Formulation)

Completely saponified polyvinyl alcohol (PVA117, trade name, product of Kuraray Co., Ltd.) was dissolved in ion-exchanged water to obtain a 9% aqueous solution. The colloidal sol of the alumina hydrate prepared in the above-described Preparation Example was concentrated to prepare a 17% sol. The colloidal sol of the alumina hydrate and the polyvinyl alcohol solution were mixed and stirred so as to give a mixing ratio of 10:1 in terms of solids, thereby obtaining a dispersion.

The dispersion, the secondary amine resin solution and the hindered amine compound emulsion were mixed and stirred to prepare a coating formulation. The secondary amine resin and hindered amine compound used and their proportions used are shown in Table 4. The proportions used were expressed by the weight ratios of the respective compounds to 100 parts, in terms of solids, of the alumina hydrate.

(Production of Recording Medium)

Each coating formulation prepared above was applied to a baryta layer of a base material (Bekk smoothness: 420 seconds, whiteness degree: 89%) having the baryta layer by a die coater so as to give a dry coating thickness of 30 g/m$^2$. The base material used at this time was obtained by coating a fibrous base having a basis weight of 150 g/m$^2$ and a St ökigt sizing degree of 200 seconds with a baryta composition composed of 100 parts of barium sulfate and 10 parts of gelatin so as to give a dry coating weight of 30 g/m$^2$ and subjecting it to a calendering treatment. A layer for forming an ink-receiving layer was formed on the base material having the baryta layer in this manner. The surface of the layer for forming an ink-receiving layer was subjected to a rewet cast treatment with hot water (80° C.) using a rewet cast coater, thereby obtaining Recording Media 23 to 30 and 34 according to the present invention and comparative Recording Media 35 and 36. The recording surfaces of the recording media thus produced all had high surface glossiness.

[Preparation Example of Recording Medium: Composition II-2 of Coating Layer]

Preparation Example II-2 of Coating Formulation)

A coating formulation was prepared in the same manner as in Preparation Example I-2 of Coating Formulation except that alumina hydrate sol prepared in Preparation Example 2 was used as the alumina hydrate sol. Similar to Preparation Example I-2, the hindered amine compound and secondary amine resin used and their proportions used are shown in Table 4.

(Production of Recording Medium)

The coating formulation prepared above was applied by die coating onto a white polyester film (Lumirror, trade name, product of Toray Industries, Inc.) having a thickness of 100 μm to form an ink-receiving layer having a thickness of 30 μm, thereby obtaining Recording Medium 31 according to the present invention. The recording surface of the recording medium thus produced had a high surface glossiness.

[Preparation Example of Recording Medium: Composition III-2 of Coating Layer]

(Preparation Example III-2 of Coating Formulation)

A coating formulation was prepared in the same manner as in Preparation Example I-2 of Coating Formulation except that colloidal silica prepared in the following manner was used in place of the alumina hydrate sol. Similar to Preparation Example I, the hindered amine compound and secondary amine resin used and their proportions used are shown in Table 4.

Preparation Example of Colloidal Silica:

Colloidal silica particles bonded in the form of a chain were prepared in accordance with the process described in Example 1 of Japanese Patent Registration No. 2,803,134.

(Production of Recording Medium)

The coating formulation prepared above was applied by die coating onto a white polyester film (Lumirror, trade name, product of Toray Industries, Inc.) having a thickness of 100 μm to form an ink-receiving layer having a thickness of 30 μm, thereby obtaining Recording Medium 32 according to the present invention. The recording surface of the recording medium thus produced had high surface glossiness.

[Preparation Example of Recording Medium: Composition IV-2 of Coating Layer]

(Preparation Example IV-2 of Coating Formulation)

Ten parts of commercially available synthetic silica (Finesil, trade name, product of Tokuyama, Soda Co., Ltd.) were added to 90 parts of ion-exchanged water to obtain a dispersion of the silica by means of a homogenizer. Completely saponified polyvinyl alcohol (PVA117, trade name, product of Kuraray Co., Ltd.) was dissolved in purified water to obtain a 10% aqueous solution. The silica dispersion prepared above and the polyvinyl alcohol solution were mixed and stirred so as to give a mixing ratio of 2:1 in terms of solids, thereby obtaining a dispersion.

The dispersion, the secondary amine resin solution and the hindered amine compound emulsion were mixed and stirred to prepare a coating formulation. The secondary amine resin and hindered amine compound used and their proportions used are shown likewise in Table 4. The proportions used were expressed by the weight ratios of the respective compounds to 100 parts, in terms of solids, of the silica.

(Production of Recording Medium)

The coating formulation prepared above was applied by means of a bar coater onto woodfree paper having a sizing degree of 25 seconds and a basis weight of 80 g/m$^2$ so as to give a dry coating weight of 15 g/m$^2$, and the surface thereof was subjected to a supercalendering treatment, thereby obtaining Recording Medium 33 according to the present invention, which had a matted recording surface.

The thus-obtained Recording Media 23 to 36 were also evaluated in the same manner as in Example 1. The results are shown in Table 4.

TABLE 4

| | Recording medium No. | Composition of coating layer | Hindered amine | | Secondary amine resin | | | Proportion used (to 100 parts of alumina hydrate or silica) | | Evaluation result of fastness properties of image | | | |
|---|---|---|---|---|---|---|---|---|---|---|---|---|---|
| | | | A | B | D-1 | D-2 | D-3 | Hindered amine | Amine resin | Xenon light fastness | Fluorescent light fastness | Gas fastness | Yellowing |
| Ex. 13 | 23 | I-2 | A-1 | | ○ | | | 5 | 2 | A | A | A | Not changed |
| Ex. 14 | 24 | I-2 | A-2 | | | ○ | | 5 | 1 | B | B | B | Not changed |
| Ex. 15 | 25 | I-2 | A-3 | | | | ○ | 5 | 2 | A | A | A | Not changed |
| Ex. 16 | 26 | I-2 | A-4 | | | | ○ | 6 | 3 | A | A | B | Not changed |
| Ex. 17 | 27 | I-2 | | B-1 | ○ | | | 5 | 1 | A | A | B | Not changed |
| Ex. 18 | 2B | I-2 | | B-2 | | ○ | | 4 | 2 | B | B | A | Not changed |

TABLE 4-continued

| Recording medium No. | Composition of coating layer | Hindered amine A | Hindered amine B | Secondary amine resin D-1 | Secondary amine resin D-2 | Secondary amine resin D-3 | Proportion used (to 100 parts of alumina hydrate or silica) Hindered amine | Proportion used (to 100 parts of alumina hydrate or silica) Amine resin | Evaluation result of fastness properties of image: Xenon light fastness | Fluorescent light fastness | Gas fastness | Yellowing |
|---|---|---|---|---|---|---|---|---|---|---|---|---|
| Ex. 19 | 29 | I-2 | B-3 | | ○ | | 5 | 1 | B | B | B | Not changed |
| Ex. 20 | 30 | I-2 | B-4 | | ○ | | 6 | 2 | B | B | A | Not changed |
| Ex. 21 | 31 | II-2 | B-5 | | | ○ | 5 | 3 | A | A | A | Not changed |
| Ex. 22 | 32 | III-2 | B-6 | | | ○ | 4 | 1 | A | A | B | Not changed |
| Ex. 23 | 33 | IV-2 | B-7 | | | ○ | 7 | 2 | A | A | A | Not changed |
| Ex. 24 | 34 | I-2 | B-8 | | | ○ | 4 | 1 | A | A | B | Not changed |
| Comp. Ex. 11 | 35 | I-2 | | | ○ | | 0 | 3 | C | C | B | Yellowed |
| Comp. Ex. 12 | 36 | I-2 | | | | ○ | 0 | 5 | C | C | A | Yellowed |

[Preparation Example of γ-Alumina]

Aluminum octoxide was synthesized in accordance with the process described in U.S. Pat. Nos. 4,242,271 and 4,202,870. The aluminum octoxide was then hydrolyzed to prepare an alumina slurry. The alumina slurry was then subjected to a post treatment such as drying to obtain powdery pseudoboehmite. This powder was calcined for 2 hours in an oven controlled at 500° C. to obtain aluminum oxide particles (hereinafter referred to as γ-alumina) having a γ crystal structure. The median of particle size distribution at this time was 20 μm. This γ-alumina was dispersed in purified water at a concentration of 20% by using acetic acid as a dispersing agent. After the resultant dispersion was then treated for 40 hours by means of a ball mill, it was subjected to a centrifugal separating treatment to remove coarse particles, thereby obtaining treated γ-alumina. The median of particle size distribution at this time was 0.25 μm.

[Preparation Example of Recording Medium: Composition of Ink-receiving Layer]

(Preparation Example of Coating Formulation)

Completely saponified polyvinyl alcohol (PVA117, trade name, product of Kuraray Co., Ltd.) was dissolved in ion-exchanged water to obtain a 9% aqueous solution. The dispersion of γ-alumina prepared in Preparation Example described above and the polyvinyl alcohol solution were mixed and stirred so as to give a mixing ratio of 10:1 in terms of solids, thereby obtaining a dispersion.

The dispersion, the primary amine resin solution and the hindered amine compound emulsion were mixed and stirred to prepare a coating formulation. The primary amine resin and hindered amine compound used and their proportions used are shown in Table 5. The proportions used were expressed by the mass ratios of the respective compounds to 100 parts, in terms of solids, of the γ-alumina.

(Production of Recording Medium)

Each coating formulation prepared above was applied to a baryta layer of a base material (Bekk smoothness: 420 seconds, whiteness degree: 89%) having the baryta layer by a die coater so as to give a dry coating thickness of 30 g/m$^2$. The base material used at this time was obtained by coating a fibrous base having a basis weight of 150 g/m$^2$ and a Stokigt sizing degree of 200 seconds with a baryta composition composed of 100 parts of barium sulfate and 10 parts of gelatin so as to give a dry coating mass of 30 g/m$^2$ and subjecting it to a calendering treatment. A layer for forming an ink-receiving layer was formed on the base material having the baryta layer in this manner. The surface of the layer for forming an ink-receiving layer was subjected to a rewet cast treatment with hot water (80° C.) using a rewet cast coater, thereby obtaining Recording Media 37 to 48 according to the present invention and comparative Recording Media 47 to 58. The recording surfaces of the recording media thus produced all had a high surface glossiness.

The recording media obtained above were also evaluated in the same manner as in Example 1. The results are shown in Table 5.

TABLE 5

| Recording medium No. | Hindered amine A | Hindered amine B | Primary amine resin C-1 | Primary amine resin C-2 | Primary amine resin C-3 | Quaternary ammonium salt compound: C-4 | Proportion used (to 100 parts of γ-alumina) Hindered amine | Proportion used (to 100 parts of γ-alumina) Amine resin | Evaluation result of fastness properties of image: Xenon light fastness | Fluorescent light fastness | Gas fastness | Yellowing |
|---|---|---|---|---|---|---|---|---|---|---|---|---|
| Ex. 25 | 37 | A-1 | ○ | | | | 5 | 2 | A | A | A | Not changed |
| Ex. 26 | 38 | A-2 | | ○ | | | 4 | 1 | B | B | B | Not changed |
| Ex. 27 | 39 | A-3 | | | ○ | | 5 | 2 | A | A | A | Not changed |
| Ex. 28 | 40 | A-4 | | | ○ | | 6 | 3 | A | A | A | Not changed |
| Ex. 29 | 41 | B-1 | ○ | | | | 5 | 1 | A | A | B | Not changed |
| Ex. 30 | 42 | B-2 | | ○ | | | 4 | 2 | B | B | A | Not changed |
| Ex. 31 | 43 | B-3 | | ○ | | | 5 | 1 | B | B | B | Not changed |
| Ex. 32 | 44 | B-4 | | ○ | | | 6 | 2 | B | B | A | Not changed |
| Ex. 33 | 45 | B-5 | | | ○ | | 5 | 3 | A | A | A | Not changed |

TABLE 5-continued

| | Recording medium | Hindered amine | | Primary amine resin | | | Quaternary ammonium salt compound: | Proportion used (to 100 parts of γ-alumina) | | Evaluation result of fastness properties of image | | | |
|---|---|---|---|---|---|---|---|---|---|---|---|---|---|
| | No. | A | B | C-1 | C-2 | C-3 | C-4 | Hindered amine | Amine resin | Xenon light fastness | Fluorescent light fastness | Gas fastness | Yellowing |
| Ex. 34 | 46 | | B-6 | | | ○ | | 4 | 1 | A | A | B | Not changed |
| Ex. 35 | 47 | | B-7 | | | ○ | | 7 | 2 | A | A | A | Not changed |
| Ex. 36 | 48 | | B-8 | | | ○ | | 4 | 1 | A | A | B | Not changed |
| Comp. Ex. 13 | 49 | | | | | | | 0 | 0 | C | C | C | Not changed |
| Comp. Ex. 14 | 50 | A-1 | | | | | | 5 | 0 | B | B | C | Not changed |
| Comp. Ex. 15 | 51 | | B-3 | | | | | 5 | 0 | B | B | C | Not changed |
| Comp. Ex. 16 | 52 | | B-1 | | | | ○ | 5 | 2 | C | C | C | Yellowed |
| Comp. Ex. 17 | 53 | A-3 | | | | | ○ | 6 | 3 | C | C | C | Yellowed |
| Comp. Ex. 18 | 54 | | | | ○ | | | 0 | 3 | C | C | B | Yellowed |
| Comp. Ex. 19 | 55 | | | | | ○ | | 0 | 5 | C | C | A | Yellowed |
| Comp. Ex. 20 | 56 | | | | | | | 0 | 0 | B | B | C | Not changed |
| Comp. Ex. 21 | 57 | | | | | | | 0 | 0 | B | B | C | Not changed |
| Comp. Ex. 22 | 58 | | | | | | | 0 | 0 | B | B | C | Yellowed |

(Preparation Example of Coating Formulation)

Completely saponified polyvinyl alcohol (PVA117, trade name, product of Kuraray Co., Ltd.) was dissolved in ion-exchanged water to obtain a 9% aqueous solution. The dispersion of γ-alumina prepared in Preparation Example described above and the polyvinyl alcohol solution were mixed and stirred so as to give a mixing ratio of 10:1 in terms of solids, thereby obtaining a dispersion.

The dispersion, the secondary amine resin solution and the hindered amine compound emulsion were mixed and stirred to prepare a coating formulation. The secondary amine resin and hindered amine compound used and their proportions used are shown in Table 6. The proportions used were expressed by the mass ratios of the respective compounds to 100 parts, in terms of solids, of the γ-alumina.

(Production of Recording Medium)

Each coating formulation prepared above was applied to a baryta layer of a base material (Bekk smoothness: 420 seconds, whiteness degree: 89%) having the baryta layer by a die coater so as to give a dry coating thickness of 30 g/m$^2$. The base material used at this time was obtained by coating a fibrous base having a basis weight of 150 g/m$^2$ and a Stokigt sizing degree of 200 seconds with a baryta composition composed of 100 parts of barium sulfate and 10 parts of gelatin so as to give a dry coating mass of 30 g/m$^2$ and subjecting it to a calendering treatment. A layer for forming an ink-receiving layer was formed on the base material having the baryta layer in this manner. The surface of the layer for forming an ink-receiving layer was subjected to a rewet cast treatment with hot water (80° C.) using a rewet cast coater, thereby obtaining Recording Media 59 to 70 according to the present invention and comparative Recording Media 71 and 72. The recording surfaces of the recording media thus produced all had a high surface glossiness.

The recording media obtained above were also evaluated in the same manner as in Example 1. The results are shown in Table 6.

TABLE 6

| | Recording medium | Hindered amine | | Secondary amine resin | | | Proportion used (to 100 parts of γ-alumina) | | Evaluation result of fastness properties of image | | | |
|---|---|---|---|---|---|---|---|---|---|---|---|---|
| | No. | A | B | D-1 | D-2 | D-3 | Hindered amine | Amine resin | Xenon light fastness | Fluorescent light fastness | Gas fastness | Yellowing |
| Ex. 37 | 59 | A-1 | | ○ | | | 5 | 2 | A | A | A | Not changed |
| Ex. 38 | 60 | A-2 | | | ○ | | 4 | 1 | B | B | B | Not changed |
| Ex. 39 | 61 | A-3 | | | | ○ | 5 | 2 | A | A | A | Not changed |
| Ex. 40 | 62 | A-4 | | | | ○ | 6 | 3 | A | A | A | Not changed |
| Ex. 41 | 63 | | B-1 | ○ | | | 5 | 1 | A | A | B | Not changed |
| Ex. 42 | 64 | | B-2 | | ○ | | 4 | 2 | B | B | A | Not changed |
| Ex. 43 | 65 | | B-3 | | ○ | | 5 | 1 | B | B | B | Not changed |
| Ex. 44 | 66 | | B-4 | | ○ | | 6 | 2 | B | B | A | Not changed |

TABLE 6-continued

| | Recording medium | Hindered amine | | Secondary amine resin | | | Proportion used (to 100 parts of γ-alumina) | | Evaluation result of fastness properties of image | | | |
|---|---|---|---|---|---|---|---|---|---|---|---|---|
| | No. | A | B | D-1 | D-2 | D-3 | Hindered amine | Amine resin | Xenon light fastness | Fluorescent light fastness | Gas fastness | Yellowing |
| Ex. 45 | 67 | | B-5 | | | ○ | 5 | 3 | A | A | A | Not changed |
| Ex. 46 | 68 | | B-6 | | | ○ | 4 | 1 | A | A | B | Not changed |
| Ex. 47 | 69 | | B-7 | | | ○ | 7 | 2 | A | A | A | Not changed |
| Ex. 48 | 70 | | B-8 | | | ○ | 4 | 1 | A | A | B | Not changed |
| Comp. Ex. 23 | 71 | | | | ○ | | 0 | 3 | C | C | B | Yellowed |
| Comp. Ex. 24 | 72 | | | | | ○ | 0 | 5 | C | C | A | Yellowed |

The recording media according to the present invention are excellent in fastness properties of images recorded thereon and particularly do not undergo fading of the images even when they are used in application fields in which the recorded images are exhibited in ordinary indoor environments such as homes and offices. The recording media according to the present invention may also be used in application fields in which recorded images having texture and image quality comparable with a silver salt photograph are provided. The image forming process according to the present invention using such a recording medium permits forming high-quality and stable images.

What is claimed is:

1. A recording medium comprising a base material, wherein a hindered amine compound and a primary amine resin are contained in the base material and/or on the surface of the base material, and wherein the ratio (by mass) of the hindered amine compound to the primary amine resin is within the range of from 10:0.5 to 0.5:10.

2. A recording medium comprising a base material, an ink-receiving layer provided on the base material, wherein a hindered amine compound and a primary amine resin are contained in the interior and/or on the surface of the ink-receiving layer, and wherein the ratio (by mass) of the hindered amine compound to the primary amine resin is within the range of from 10:0.5 to 0.5:10.

3. The recording medium according to claim 2, wherein aluminum oxide particles are contained in the ink-receiving layer.

4. The recording medium according to claim 3, wherein the aluminum oxide particles are particles of an alumina hydrate or particles of γ-type aluminum oxide.

5. The recording medium according to claim 2, wherein silica particles are contained in the ink-receiving layer.

6. The recording medium according to claim 2, wherein the primary amine resin has a number average molecular weight of from 10,000 to 500,000.

7. The recording medium according to claim 6, wherein the primary amine resin has a number average molecular weight of from 10,000 to 100,000.

8. The recording medium according to claim 2, wherein the ink-receiving layer is dried by pressing the ink-receiving layer in a wet state against a specular drum the surface of which has been heated, the specular glossiness of the surface of the ink-receiving layer is at least 20% as measured at 20°, and the recording medium is used in ink-jet recording.

9. An image forming process, comprising the step of applying a recording liquid to the surface of the ink-receiving layer of the recording medium according to claim 2 according to recording information to form an image.

10. The recording medium according to claim 2, wherein the primary amine resin is at least one resin selected from polyallylamine, polyvinylamine and salts thereof.

11. The recording medium according to claim 2, wherein the ratio (by mass) of the hindered amine compound to the primary amine resin is within the range of from 10:1 to 1:1.

12. An image forming process, comprising the step of applying a recording liquid to the surface of the recording medium according to claim 1 according to recording information to form an image.

13. The recording medium according to claim 1, wherein the primary amine resin has a number average molecular weight of 10,000 to 500,000.

* * * * *

UNITED STATES PATENT AND TRADEMARK OFFICE

CERTIFICATE OF CORRECTION

PATENT NO. : 6,811,839 B2
DATED : November 2, 2004
INVENTOR(S) : Hiro et al.

It is certified that error appears in the above-identified patent and that said Letters Patent is hereby corrected as shown below:

Column 2,
Line 4, “particles” should read -- particles are --.

Column 8,
Line 34, “such” (second occurrence) should be deleted.
Line 45, “As” should read -- as --.

Column 10,
Line 8, “apply” should read -- applied --.

Column 13,
Line 6, “thepo-” should read -- the po- --.

Column 25,
Table 4, “Ex. 18 2B” should read -- Ex. 18 28 --.

Signed and Sealed this

Twenty-sixth Day of April, 2005

JON W. DUDAS
*Director of the United States Patent and Trademark Office*

UNITED STATES PATENT AND TRADEMARK OFFICE

CERTIFICATE OF CORRECTION

PATENT NO. : 6,811,839 B2
DATED : November 2, 2004
INVENTOR(S) : Hiro et al.

It is certified that error appears in the above-identified patent and that said Letters Patent is hereby corrected as shown below:

Column 2,
Line 4, “particles” should read -- particles are --.

Column 8,
Line 34, “such” (second occurrence) should be deleted.
Line 45, “As” should read -- as --.

Column 10,
Line 8, “apply” should read -- applied --.

Column 13,
Line 6, “thepo-” should read -- the po- --.

Column 25,
Table 4, “Ex. 18 2B” should read -- Ex. 18 28 --.

Signed and Sealed this

Third Day of May, 2005

JON W. DUDAS
*Director of the United States Patent and Trademark Office*